United States Patent [19]

Hsu et al.

[11] Patent Number: 5,016,625

[45] Date of Patent: May 21, 1991

[54] FULL HEAD RESPIRATOR

[76] Inventors: Chi-Hsueh Hsu, 4F, No. 144, Chu Lin Road, Yung Ho, Taipei, Taiwan; Wen-Li Yang, No. 57, Lane 20, Chih Yu Road, Sec. 2, Shih Lin District, Taipei, Taiwan; Shien-Yu Chuang, No. 92-1, Pai Ma Chuang, Chung Li, Taoyuan Hsien, Taiwan

[21] Appl. No.: 397,399

[22] Filed: Aug. 23, 1989

[51] Int. Cl.[5] ..... A62B 18/10; A62B 7/10; A62B 19/00; A62B 23/02

[52] U.S. Cl. ..... 128/201.25; 128/201.28; 128/201.24; 128/206.12; 128/206.16

[58] Field of Search ..... 128/201.22, 201.24, 128/201.23, 201.25, 201.26, 201.28

[56] References Cited

U.S. PATENT DOCUMENTS

| | | | |
|---|---|---|---|
| 2,435,167 | 1/1948 | Stetson | 128/201.23 |
| 2,437,755 | 3/1948 | Rich | 128/201.23 |
| 2,764,152 | 9/1956 | Osterberg | 128/201.23 |
| 3,565,068 | 2/1971 | Bickford | 128/201.25 |
| 4,052,984 | 10/1977 | Brockway | 128/201.23 |
| 4,231,118 | 11/1980 | Nakagawa | 128/201.25 |
| 4,382,440 | 8/1983 | Kapp et al. | 128/201.25 |

FOREIGN PATENT DOCUMENTS

| | | | |
|---|---|---|---|
| 1060227 | 11/1953 | France | 128/201.23 |

*Primary Examiner*—Edgar S. Burr
*Assistant Examiner*—Kimberly L. Asher
*Attorney, Agent, or Firm*—Morton J. Rosenberg; David I. Klein

[57] ABSTRACT

A full head respirator to filter the air of smoke and fumes, that includes an infrastructure capable of fitting over a human head and adaptable to all sizes and shapes of wearers. The infrastructure is formed by a plurality of intersecting air tubes. The respirator has a covering made of flexible flame-resistant material that is adapted to envelop the human head and neck, mounted on the infrastructure and secured thereto. The covering has a transparent eyepiece, and filter means. The respirator has a mechanism for generating a foam to fill the air tubes of the infrastructure, and thereby fit them about the head of a wearer, and fastening mechanisms to secure the respirator on the head of the wearer.

1 Claim, 7 Drawing Sheets

FULL HEAD RESPIRATOR

BACKGROUND OF THE INVENTION

This invention relates to a respirator, and more particularly to a full head respirator to filter the air of smoke and fumes resulting from a fire.

It is often known that many people die of suffocation in a building, especially a large and high building, which is on fire. The suffocation is mainly caused by inhaling too much of a poisonous gas, such as carbon monoxide, due to the lack of a proper filter.

For dramatically diminishing the tragedy of these accidental events, respirators should be stored in staircases or other suitable spaces of a building for emergency usage.

Nowadays a variety of respirators are widely used in many fields. These respirators comprise a semi-rigid frame with a shape conforming closely to the shape of the human face and are provided with either a unitary curved transparent visor or two spaced apart transparent eyepieces, and filter means. There are some disadvantages associated with the use of such respirators. First, the semi-rigid frame of the respirator may not fit the face of the wearer, resulting in the respirator being worn in an ineffective, or non airtight manner and smoke may leak into the respirator. Moreover, they are space-consuming and dirty during storage.

Second, a fireman wearing a fire-protection overcoat and such a prior art respirator may be burnt on his neck portion. The inventor has attempted to make an improved respirator to overcome the drawbacks of known respirators.

OBJECT OF THE INVENTION

Accordingly, it is an object of this invention to provide a full head respirator which can diminish the disadvantages of known respirators.

It is another object of this invention to provide a full head respirator which is light in weight and foldable for storage.

It is still another object of this invention to provide a full head respirator which is effective in filtering air of smoke and fumes.

BRIEF DESCRIPTION OF THE DRAWINGS

The present preferred exemplary embodiment will be described in detail with respect to the following drawings, wherein.

DETAILED DESCRIPTION OF THE PREFERRED EMBODIMENT

Figure 1:
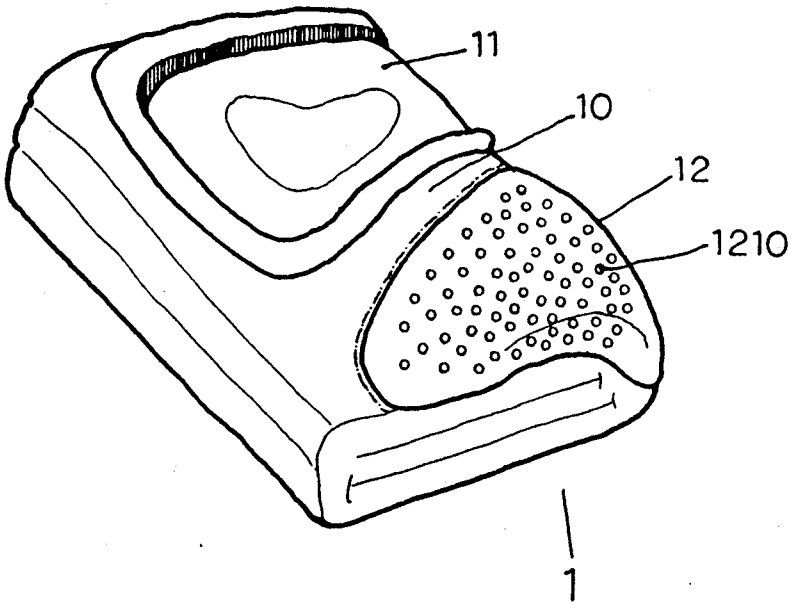
FIG. 1 is a perspective view of a preferred embodiment of a full head respirator according to this invention which is in folded condition.
Figure 2:
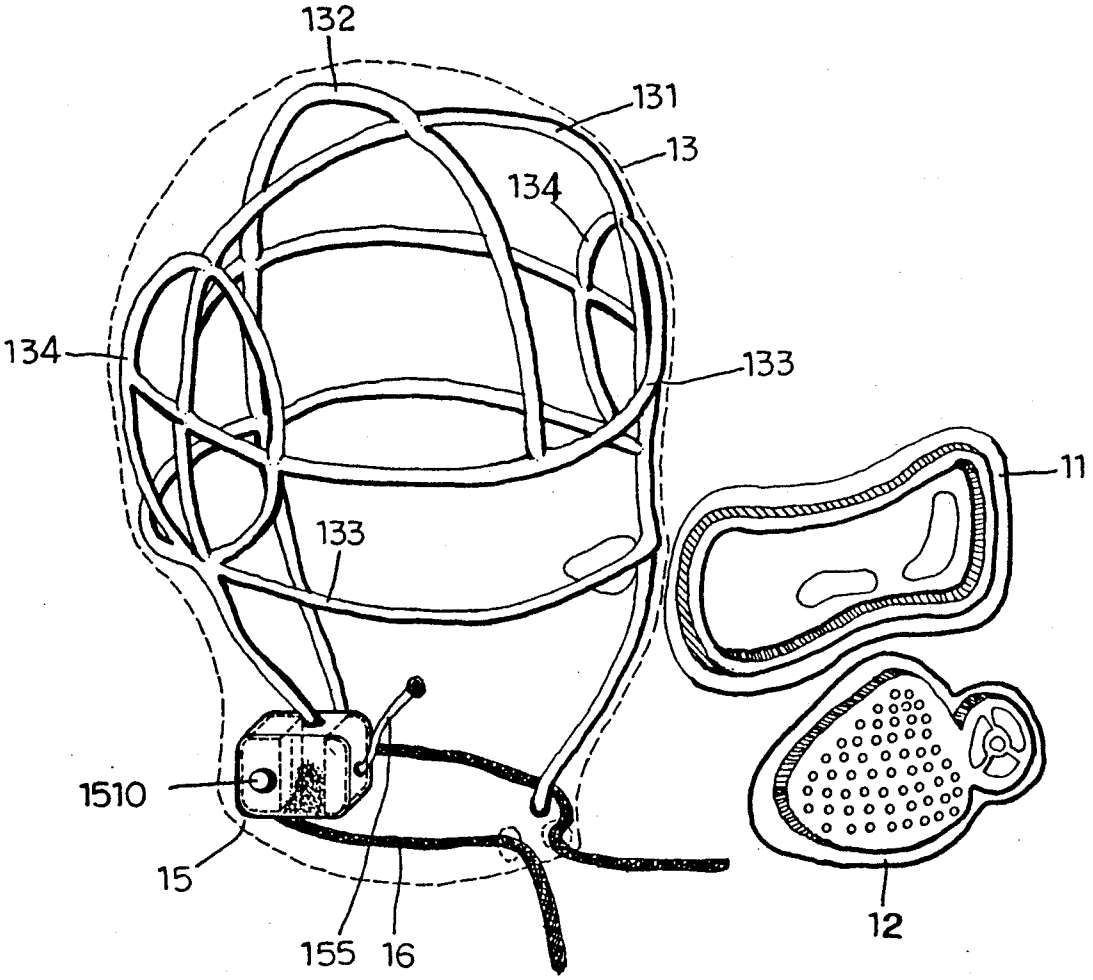
FIG. 2 is a perspective view showing an infrastructure, a transparent eyepiece, a vent device, an actuation device and a fastening string used in this invention.
Figure 6:
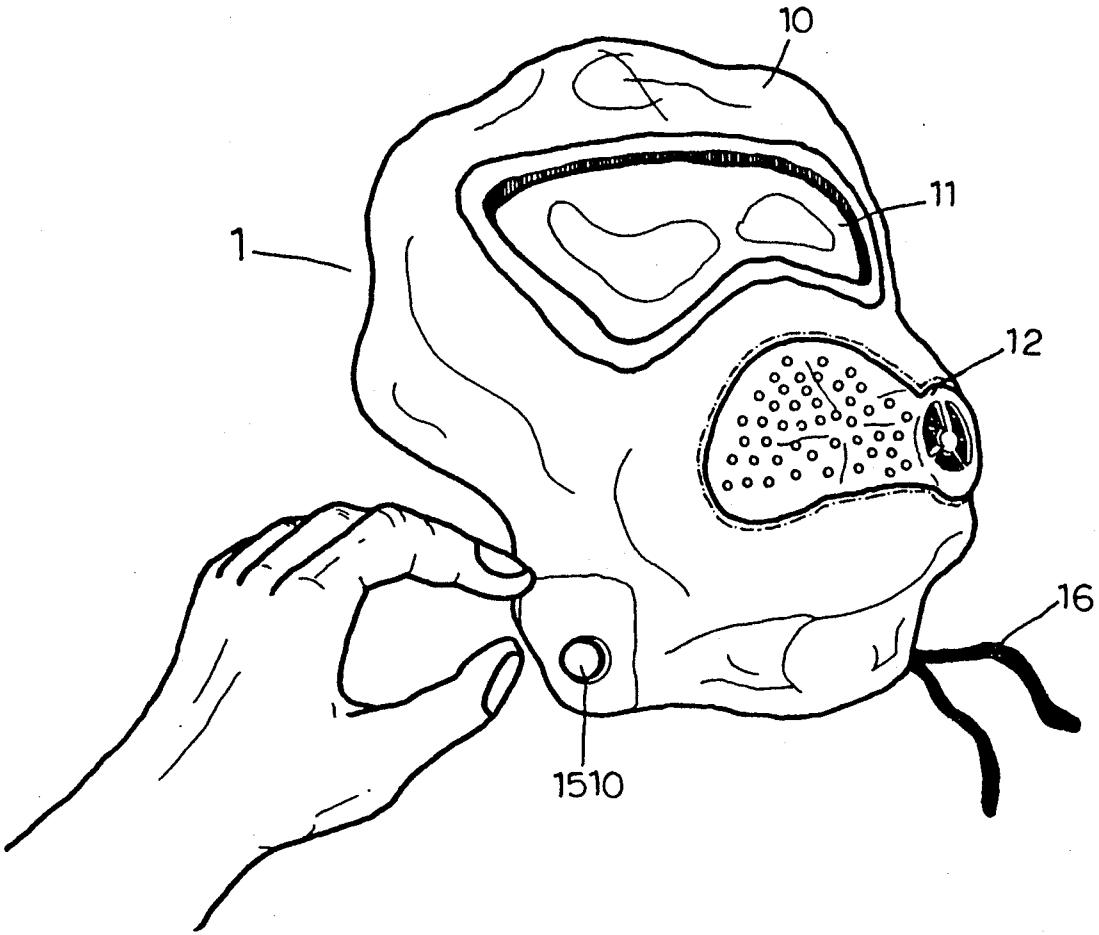
FIG. 6 is a perspective view of the full head respirator of this invention showing the respirator in preparation for usage.

As shown in FIGS. 1, 2 & 6, the full head respirator according to this invention includes an infrastructure 13 capable of fitting over a human head and adaptable to all sizes and shapes of wearers. The infrastructure 13 is constructed by a number of air tubes which are adapted to be filled with air or gas, so as to expand into a skull-shaped cranium section having two cross intersecting tubes 131, 132, a pair of parallel loops 133, and opposed ear rings 134.

A head covering 10, made of a flexible, heat-resistant material that protects the user from the fire, and adapted for fitting over and enveloping the human head and neck, is provided which is mountable on the infrastructure 13, and further secured thereto adhesively. The structure of the head covering 10 includes a skull-shaped cranium section a face portion, and a neck portion continuous therewith. The face portion includes a viewing window corresponding to the eyes of a wearer fitted with a transparent eyepiece 11, and a vent port corresponding to the nose and mouth of the wearer, fitted with a vent device 12.

Figure 3:
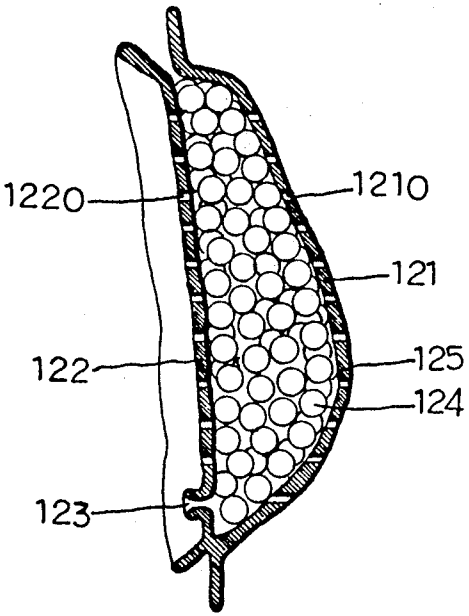
FIG. 3 is a cross-sectional view of the vent device shown in FIG. 2.
Figure 4:
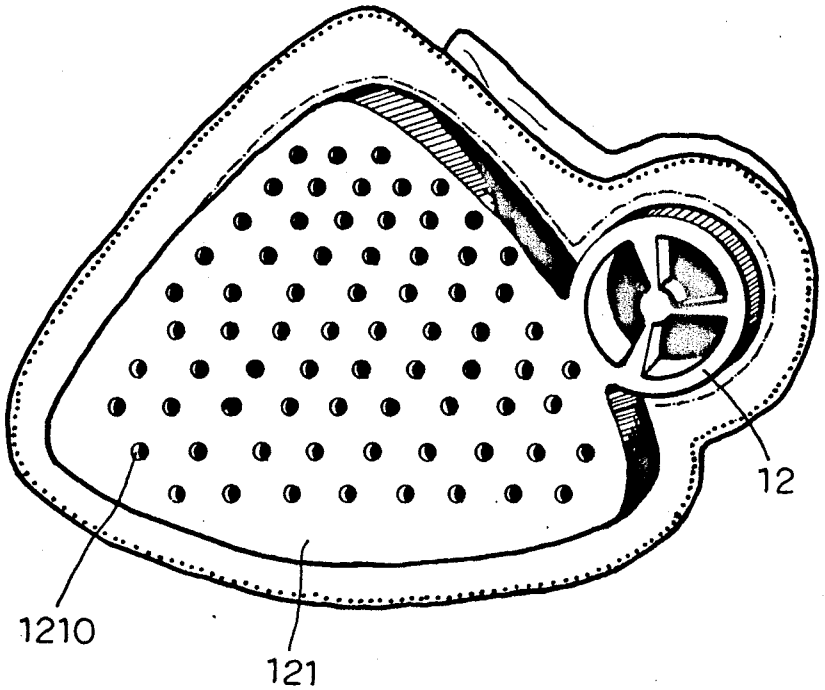
FIG. 4 is an enlarged perspective view of the vent device.

Referring to FIGS. 3 & 4, the vent device 12 comprises a perforated convex front wall 121, made of a plastic material and having a plurality of perforations 1210, and a perforated rear wall 122, having a plurality of perforations 1220 and an inlet 123 so as to define a chamber 125 which fully accommodates textile material 124.

A fastening string 16, inserted in the lowermost end of the head covering 10, fixedly and preferably air-tight fastens the head covering 10 in position over the head and neck of the wearer by properly tightening the string 16 around the neck.

An actuator 15, miniature in size, is provided in the head covering 10. The actuator comprises a housing 15 with its inner space divided into three compartments 151, 153, 154, by means of two spaced partition plates 158, 159. The first compartment 151 is located on one side of the housing and separated from the other compartments by partition plate 158. Partition plate 158 has a weak zone 152. The first compartment holds clear water. The second compartment 154 is in the opposite side of the housing from the chamber 151, and is separated from a middle compartment by partition plate 159, which is made of resilient material. The second compartment contains a liquid chemical used to wet the textile material 124 in the vent device 12. The wet textile material diminishes or filters poisonous gases generated by the fire, such as carbon monoxide. A third compartment 153, located between the first and second compartments 151, and 154, accommodates soda powder 156.

Figure 5:
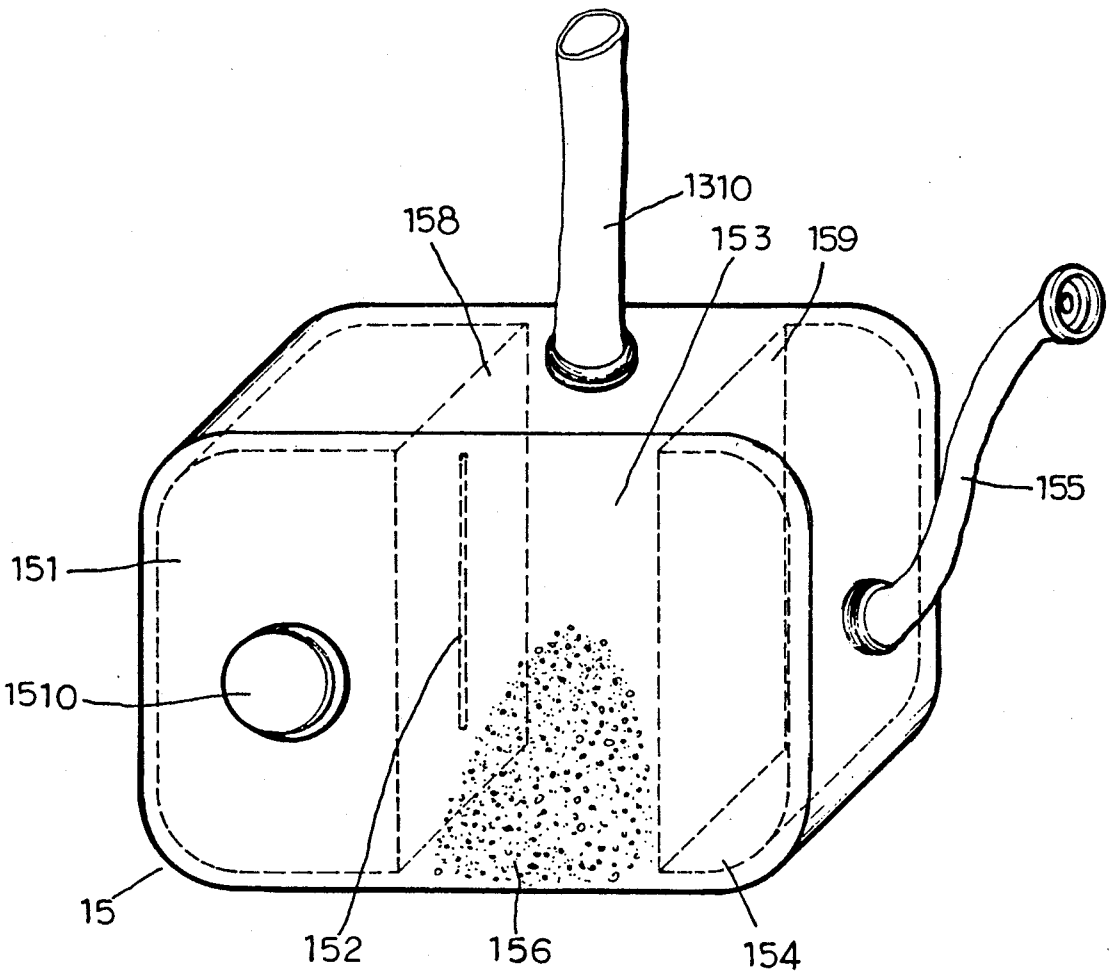
FIG. 5 is an enlarged perspective view of the actuation device shown in FIG. 2.

The clear water in the first chamber 151 splits the weak zone 152 when push button 1510, mounted on a side wall of the housing 15, is pressed. The water flows into the third chamber 153 and reacts with the soda powder 156 so as to cause the soda to foam and expand, as shown in FIG. 5.

An inlet end 1310 of the communicative air tubes of the infrastructure is connected to the third chamber 153 of the housing 15. The expanding foam, in association with air or gas, discharges through the inlet end 1310 and thus automatically fills the air tubes of the infrastructure with the discharging air or gas, and expands the infrastructure to fit the wearer's head. The expanding foam also pushes the resilient partition plate 159, and discharges the liquid chemical into the vent device 12 through a conduit 155 and the inlet 123 of the rear wall 122 of the vent device 12.

Figure 7:
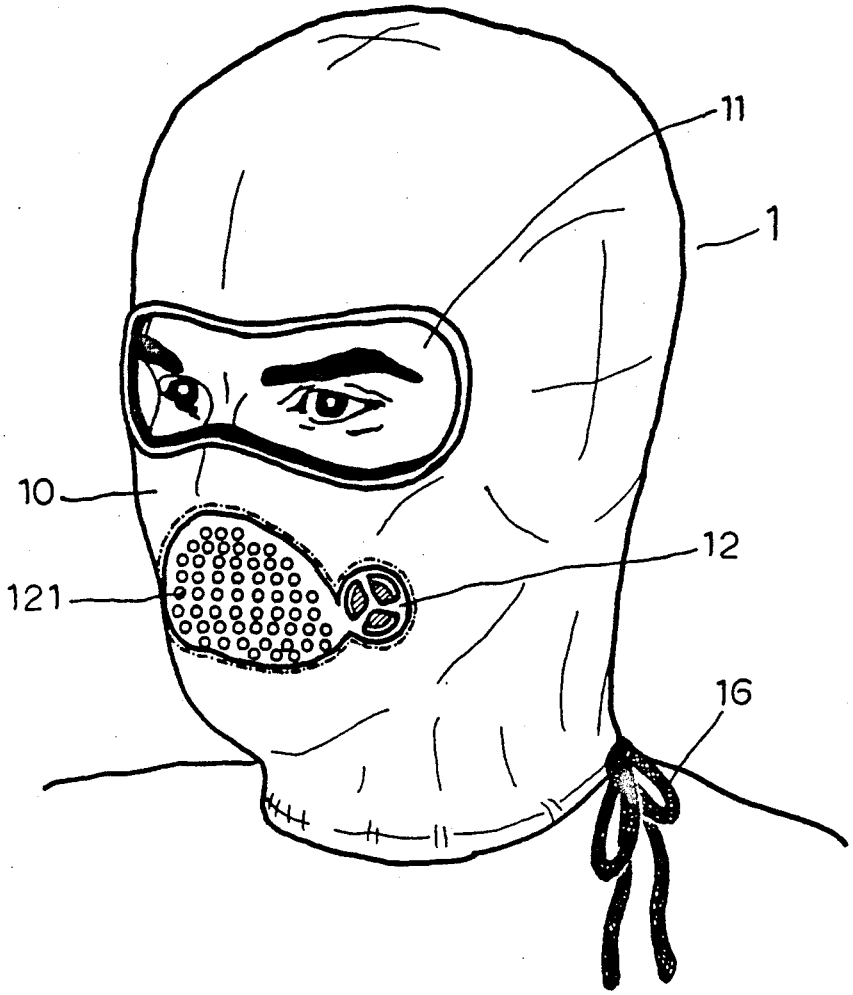
FIG. 7 is a perspective view of the full head respirator of this invention showing the respirator in use.

Referring to FIG. 7, the full head respirator 1 envelops the head and neck of the wearer, and is fixedly secured in position by means of the fastening string 16 with the push button 1510 of the actuator 15 is positioned on exterior of the head covering 10.

Figure 9:
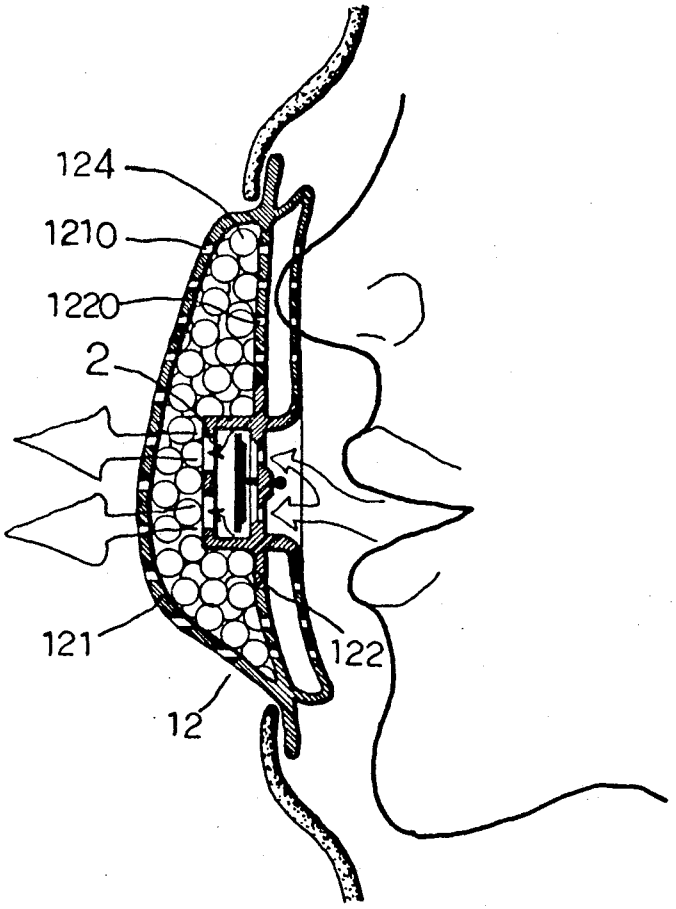
FIG. 9 is a cross-sectional view of the vent device in exhaling action of this invention which is in use.
Figure 8:
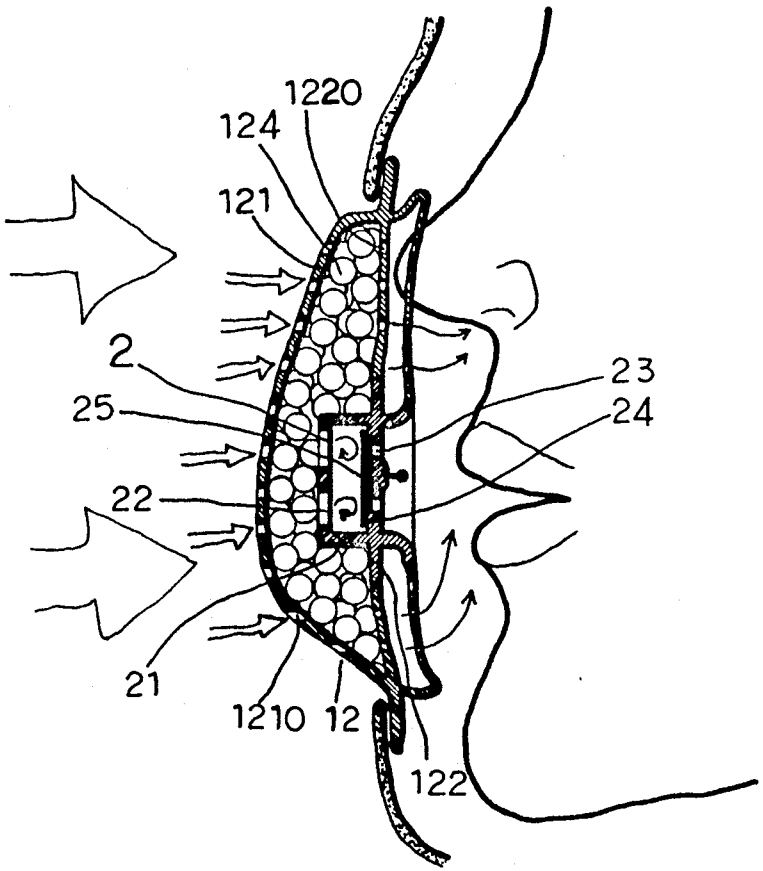
FIG. 8 is a cross-sectional view of the vent device in inhaling action of this invention which is in use.

As shown in FIGS. 8 & 9, an alternate embodiment of the vent device 12 is provided. The vent device 12 comprises a check valve device 2 mounted on the rear wall 122 in a portion corresponding to the mouth of the wearer. The check valve device 2 has a cylindrical side wall 21 extending forwardly towards the front wall 121, an opening 22 facing the front wall 121 and formed in the front end thereof, and vent holes 23 in a base 24. During inhalation as shown in FIG. 8, the check valve 2 is closed by means of a valve diaphragm 25. During exhalation, the check valve 2 is opened to allow exhaled air to escape to the atmosphere.

Many modifications of this invention, within the scope of the appended claim, may be made without departing from the spirit of this invention.

What is claimed is:

1. A full head respirator to filter air of smoke and fumes comprising:

a flexible, generally continuous infrastructure, said infrastructure adjustably sized to fit over a human head;

said infrastructure comprising a plurality of intersecting conducting tubes in communication;

said tubes having a common inlet end;

a cover mounted on said infrastructure and secured thereto, said cover constructed of a flexible, heat-resistant material;

said cover including a cranium portion, a face portion, and a neck portion, said portions enveloping the head and neck of the wearer;

said face portion having a viewing window which covers the eyes of the wearer, and a vent portion covering the nose and mouth of the wearer for inhalation and exhalation;

said viewing window fitted with a transparent eyepiece;

said vent device having a perforated front wall and a perforated rear wall, said rear wall having an inlet, said perforated walls defining therebetween a chamber filled with a textile material;

an actuation means that generates foam, said actuation means having a housing that is divided into three compartments;

a first compartment that is filled with clear water, a second compartment that is filled with a filtering chemical in liquid form, and a third compartment disposed between said first and second compartments, and separated from said second compartment by means of a resilient side wall, and separated from said first compartment by means of a rupturable side wall, said third compartment being filled with soda powder;

said common inlet end of said tubes being in communication with said second compartment;

means for rupturing said rupturable side wall and thereby mixing said water and soda to generate said foam, the foam expanding and filling said tubes so as to fit them about the head of the wearer;

conduit means interconnecting said second compartment with said inlet of said vent device, said conduit feeding said liquid filtering chemical to said textile material, whereby air inhaled by the wearer through said front perforated wall is filtered; and, a fastening string for securing said cover on the wearer by tightening of the string around the neck of the wearer.

* * * * *